US006345631B1

(12) United States Patent
Brunson

(10) Patent No.: US 6,345,631 B1
(45) Date of Patent: Feb. 12, 2002

(54) SILO TYPE STORAGE TANK WITH CLEAN-IN-PLACE SPRAY OPENING AND OVERFLOW TUBE

(76) Inventor: Jeffrey W. Brunson, 1406 N. Owen Rd., Nixa, MO (US) 65714

( * ) Notice: Subject to any disclaimer, the term of this patent is extended or adjusted under 35 U.S.C. 154(b) by 0 days.

(21) Appl. No.: 09/392,863

(22) Filed: Sep. 9, 1999

(51) Int. Cl.[7] ..... B08B 9/08

(52) U.S. Cl. ..... 134/22.1; 134/22.18; 134/166 R; 134/169 R

(58) Field of Search ..... 134/166 R, 167 R, 134/167 C, 168 R, 168 C, 169 R, 169 C, 166 C, 22.1, 22.11, 22.18

(56) References Cited

U.S. PATENT DOCUMENTS 3,031,148 A * 4/1962 Holdren ..... 134/166 R
3,655,245 A * 4/1972 Schumacher
3,953,226 A * 4/1976 Emond et al. ..... 134/168 R
4,192,332 A 3/1980 Feldmeier
4,386,637 A * 6/1983 Buchanan et al. ..... 134/167 R
4,764,221 A * 8/1988 Hartwigsen et al.
5,301,702 A * 4/1994 McKinney ..... 134/167 R
5,381,923 A 1/1995 O'Dea
5,538,038 A * 7/1996 Boytim et al.
5,594,973 A * 1/1997 Brusseleers et al. ..... 15/304
5,649,338 A * 7/1997 Kato
5,660,214 A 8/1997 Pettesch

* cited by examiner

*Primary Examiner*—Frankie L. Stinson
(74) *Attorney, Agent, or Firm*—Howell & Haferkamp LC

(57) ABSTRACT

A silo type storage tank includes a clean-in-place system comprising a flush opening located at about four and one half inches below the weld seam joining the tank top to the sidewall and fed by an upwardly angled channel in the tank sidewall arranged at approximately 17 degrees from the interior surface of the tank sidewall, and a generally vertically extending overflow tube that has its opening aligned with the lower lip of the tank sidewall opening so that cleaning fluid flowing through the tank sidewall opening and the overflow tube washes the entire interior surfaces of the tank.

21 Claims, 6 Drawing Sheets

SILO TYPE STORAGE TANK WITH CLEAN-IN-PLACE SPRAY OPENING AND OVERFLOW TUBE

BACKGROUND AND SUMMARY OF THE INVENTION

Silo type storage tanks are commonly used for containing foodstuffs during processing and/or storage. These tanks can be quite large, ranging from a little over eight feet to a little over twelve feet in diameter in a typical application, and up to a little over twelve feet tall. In order to meet sanitary standards set by a number of regulatory agencies, including 3-A and the USDA, it is necessary that all of their internal surfaces be amenable to being completely cleaned on a periodic basis. One prior art device that has been provided to accomplish this includes a spray nozzle and spray dish located at the top center of the tank, wherein the cleaning fluid sprays through the nozzle and is deflected off the spray dish and against the top and sidewalls to cascade the cleaning fluid down the tank surfaces to thereby clean them. A supply line carries the cleaning solution from the alcove, up the outside of the tank, through the top head, and onto the spray dish. This arrangement requires a ladder, cage, guardrail, and possibly a catwalk to gain access for maintenance and inspection, thus entailing an added layer of expense and inconvenience. In some applications this cleaning apparatus is removable, which then further increases the expense due to the need for ferrules, clamps, and gaskets to accommodate its disassembly/re-assembly. Another attempt in the prior art to address this cleaning problem is shown in U.S. Pat. No. 4,192,332 which discloses a jet spray nozzle located in the lower portion of the tank, extending inwardly from the alcove area. With this device, cleaning fluid is sprayed through spray nozzles at high pressure upwardly against the top and upper sidewalls of the tank so that it may cascade down and clean. This device is similar to a spray ball and requires high pressure and flow rates, all of which again increases the initial cost and on-going operating expense.

These various prior art attempts to solve the cleaning problem all suffer drawbacks which heretofore were unavoidable. They require in some cases significant structural devices (ladders, etc.) which are unsightly, costly, and entail some degree of risk for the workman who must inspect and maintain the cleaning system. Alternately, with the spray ball device, a rather complicated device must be provided which again represents a significant expense, and which itself must be removable from the tank for it to be cleaned and to avoid interference with the operation of the tank. Furthermore, there must be periodic inspection and maintenance. Neither of these approaches allow for the cleaning operation to be conducted automatically and without an operator getting physically involved at some point in time either for operation or maintenance.

In order to solve these and other problems in the prior art, the inventor has succeeded in designing and developing a clean-in-place fixture for a silo type storage tank which is elegantly simple, which eliminates the need for operator intervention, which is self cleaning, which has no special structure requiring expensive manufacture or maintenance, and which effectively cleans all interior surfaces of the tank while remaining fixed in place and without interfering with the operation of the tank. Essentially, the present invention comprises a channel, duct, tube, or other passageway which is located near the top of the tank and which has an "angle of attack" such that a spray emanating therefrom effectively sprays the tank top and virtually the entirety of the tank sidewalls. An overflow tube, which is preferably a vertically oriented standpipe, has its mouth located adjacent the channel outlet so that cleaning fluid overflows out of the tube and against the sidewall just beneath the channel outlet to wash the sidewall beneath it, as well as the outer surfaces of the overflow tube itself The overflow tube thus cleans that small portion of the tank interior which may be missed by cleaning fluid spraying out of the channel.

The "angle of attack" and physical location for the channel may be readily determined in the field for any particular tank size and dimension. However, the inventor has determined that a particular location and "angle of attack" works well with a broad range of tank sizes, and thus represents his preferred embodiment as explained below. By "angle of attack" is meant that angular orientation of the channel with respect to the interior tank sidewall. The inventor has also determined a channel size as his preferred embodiment which will provide an effective cleaning using the expected flow rates and pressures that have been adopted in the industry. Thus the present invention is readily adaptable to any existing or new installation without the need for extensive considerations of cleaning fluid pumps or supplies. It has also been determined that these factors are somewhat interrelated such that changing one may be accommodated for by changing another, and yet provide an effective cleaning. Therefore, there is some flexibility in the implementation of the present invention which will allow for user or designer preference.

Thus, the present invention represents a significant advance over the prior art by eliminating structural devices, thereby providing an elegantly simpler device at less cost, maintenance, and with greater flexibility in implementation. While the principal advantages and features of the invention have been briefly explained above, a greater understanding of the invention may be attained by referring to the drawings and description of the preferred embodiment which follow.

DETAILED DESCRIPTION OF THE PREFERRED EMBODIMENT

Figure 1:
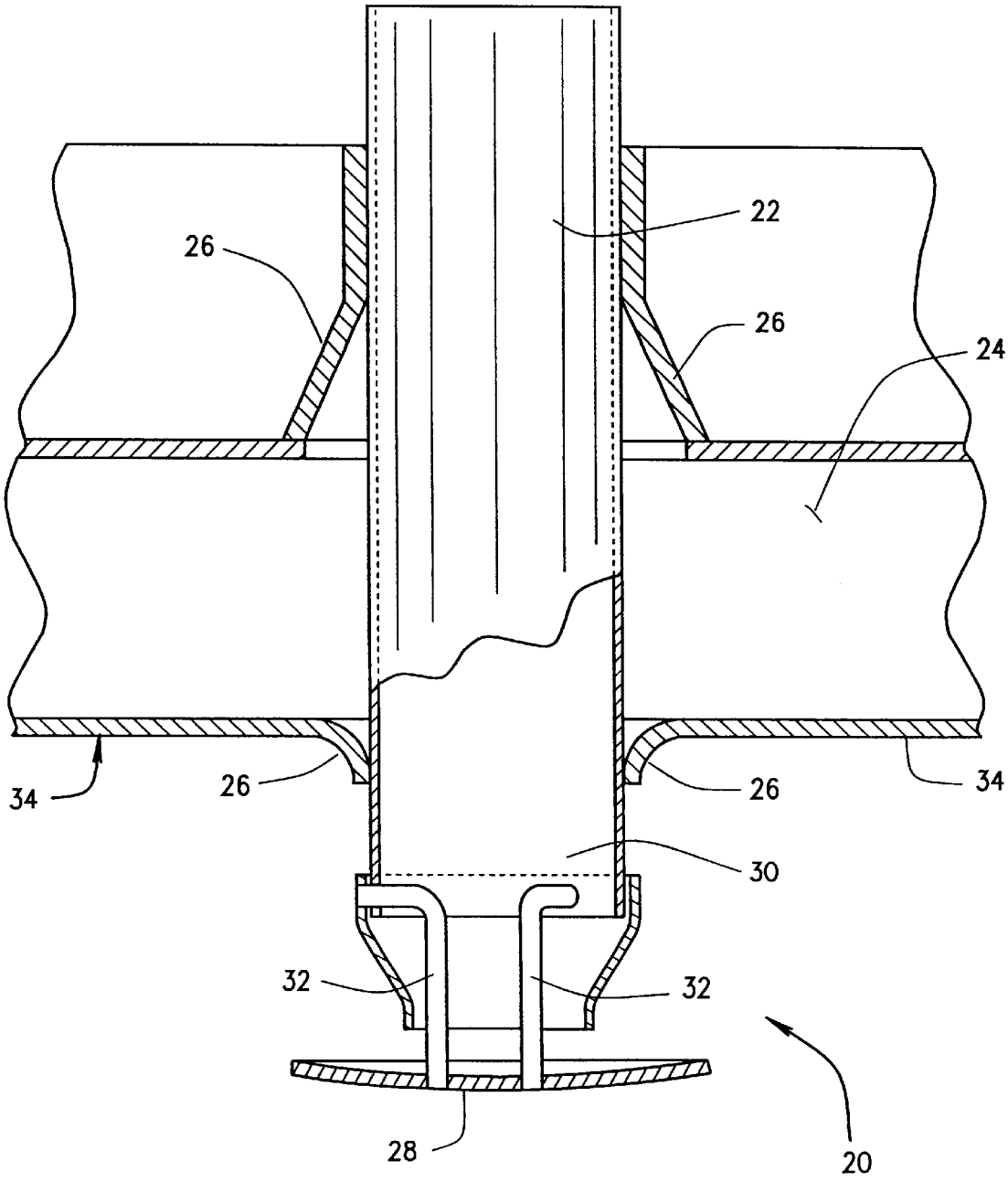
FIG. 1 PRIOR ART
FIG. 1 is a cross-sectional view of a prior art spray dish device used for cleaning a silo type storage tank.
Figure 2:
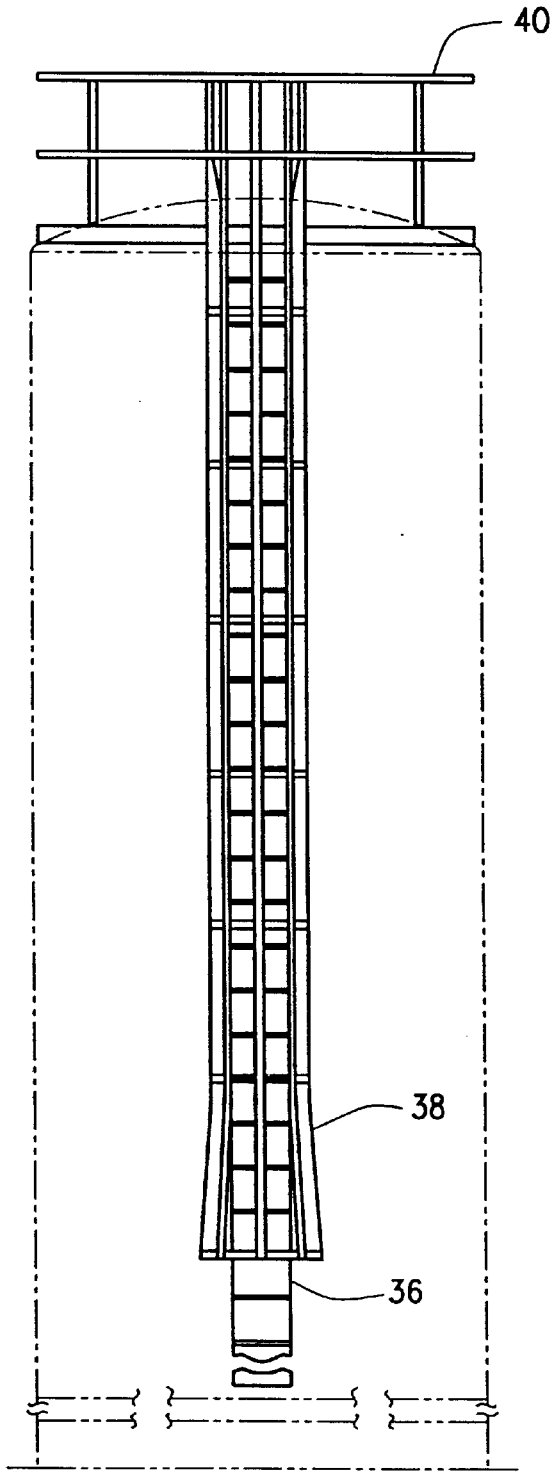
FIG. 2 PRIOR ART
FIG. 2 is a cross-sectional view of a prior art silo type storage tank with the necessary ladders, etc. as needed with the prior art cleaning device of FIG. 1.
Figure 3:
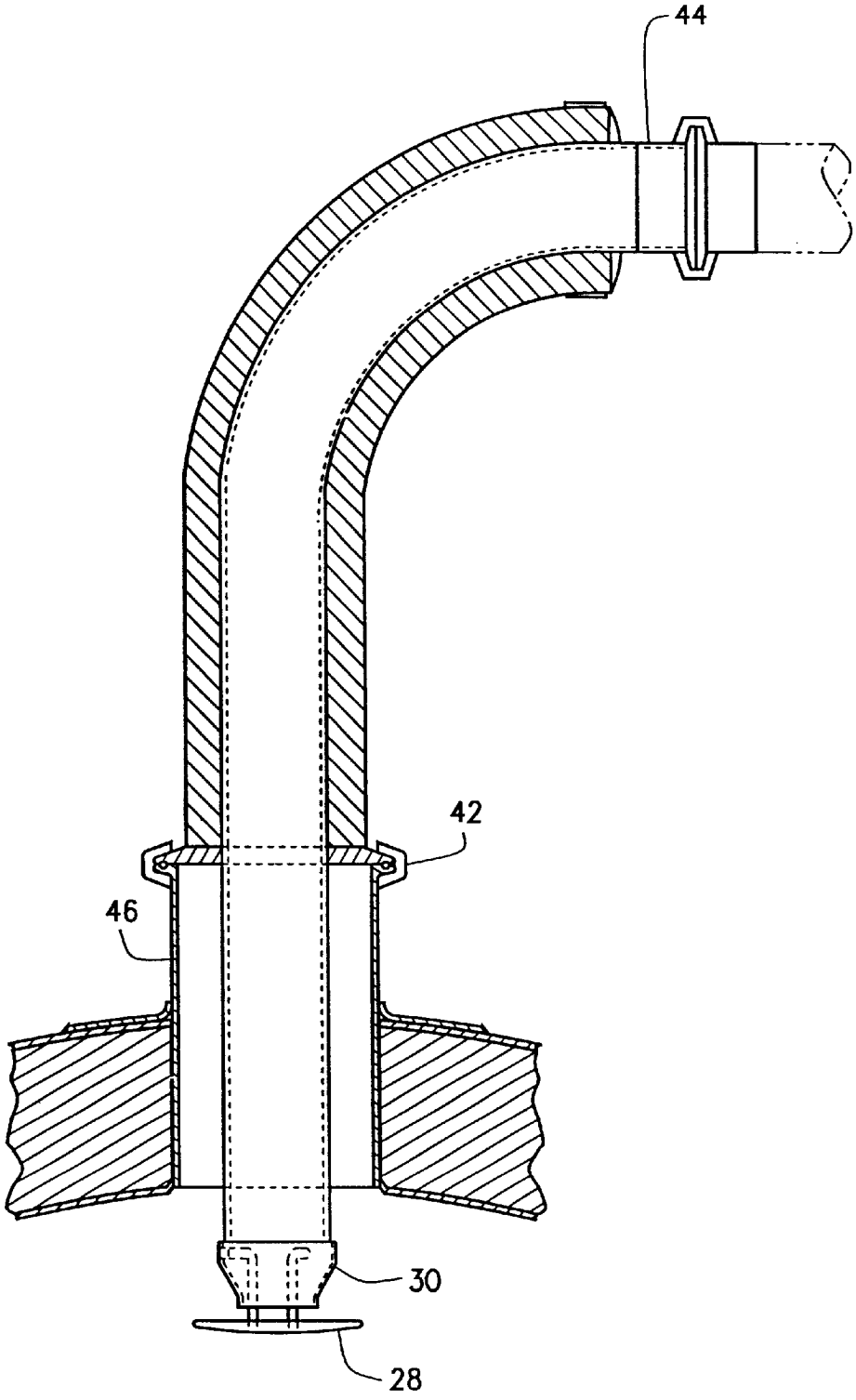
FIG. 3 PRIOR ART
FIG. 3 is a cross-sectional view of a prior art spray dish device used for cleaning a silo type storage tank that is also removable.
Figure 4:
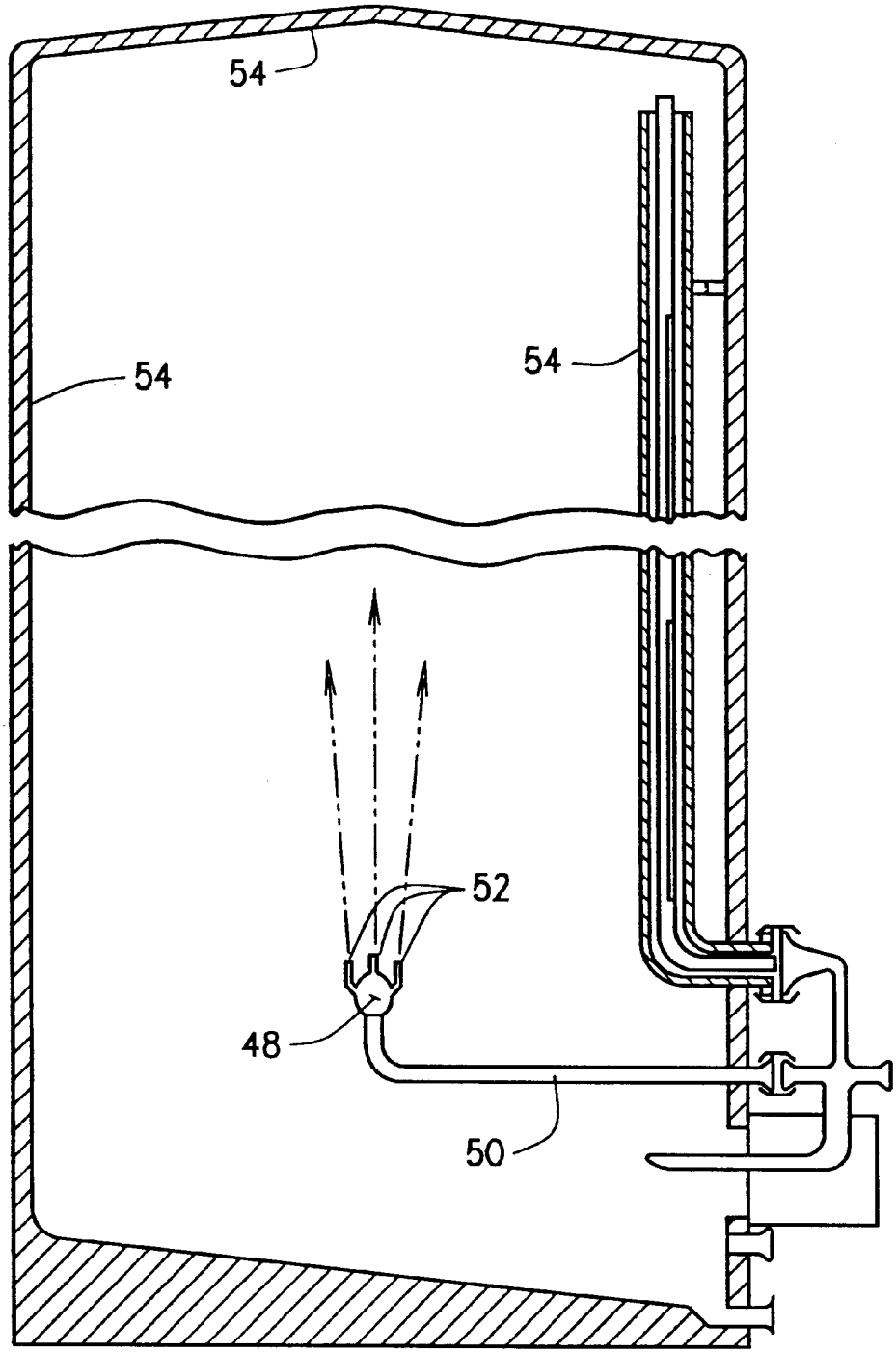
FIG. 4 PRIOR ART
FIG. 4 is a cross-sectional view of a second prior art device comprising a high pressure spray ball for cleaning a silo type storage tank.

As shown in FIG. 1, one type of prior art device 20 comprises a supply line 22 extending through the top 24 of the tank (not shown), and welded into place at 26. A spray dish 28 is attached to the lower end 30 of the supply line 22 by braces 32 with spray dish 28 being substantially arcuate in shape to deflect cleaning fluid upwardly and against the interior surfaces 34 of the tank top and which will then cascade down the sidewalls to clean the tank interior. As the prior art device 20 is mounted in the tank top 24, as shown in FIG. 2 a number of additional structural elements such as a ladder 36, cage 38, rail 40, etc. must be provided to allow for the inspection and maintenance of the spray dish 28 at the tank top 24. In some prior art installations, the spray dish 28 is removable as shown in FIG. 3. This requires a clamp 42 to seal a removable supply line 44 to a fitting 46 at the tank top 24, which is more complicated and costly. Still another prior art device is shown in FIG. 4 and includes a spray head 48 mounted at the end of a wand 50 with the spray head 48 having a plurality of high pressure spray nozzles 52 through which cleaning fluid is sprayed onto the tank interior 54. This apparatus must be periodically disassembled and thus is not only costly but also labor intensive.

Figure 5:
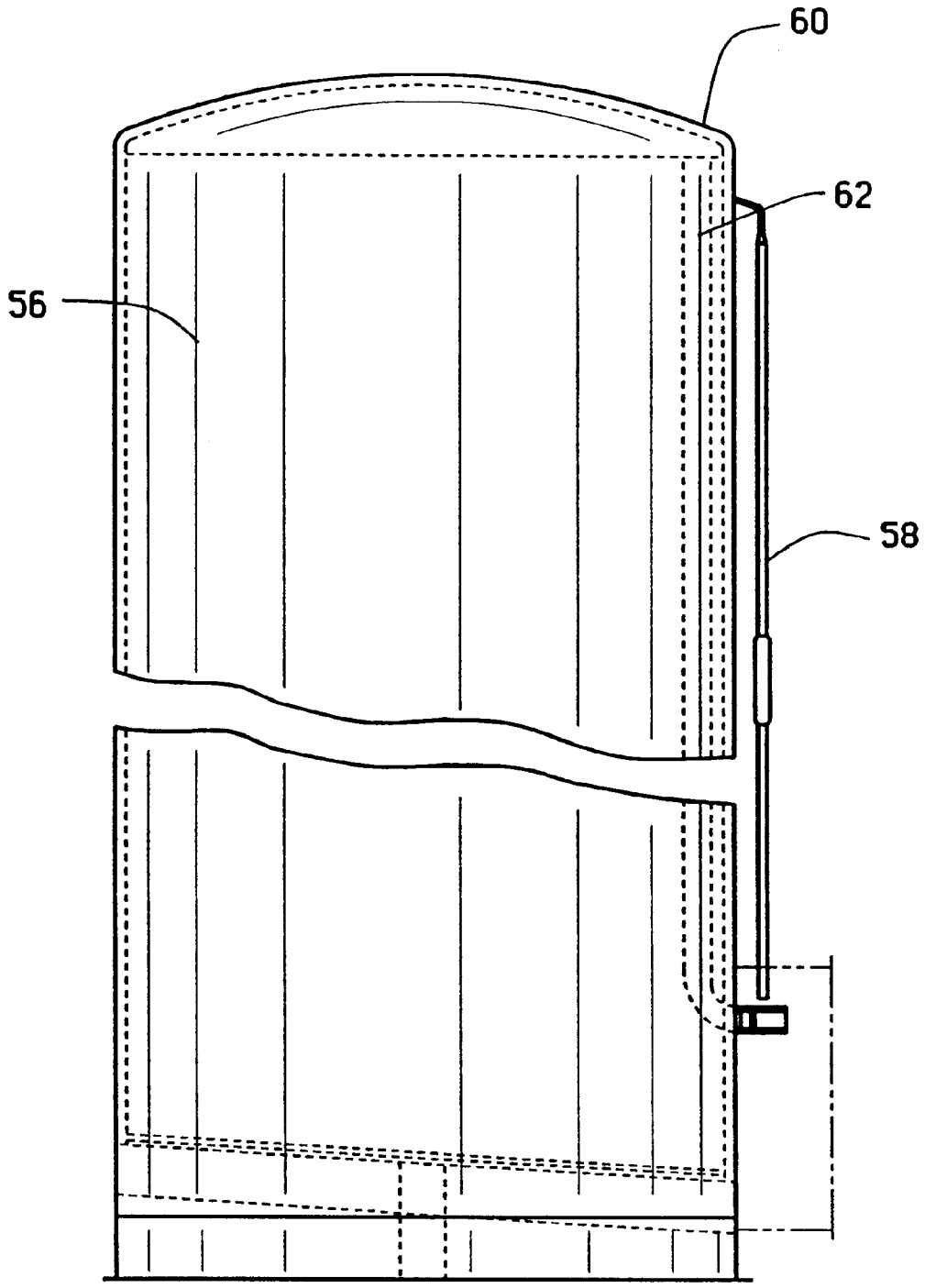
FIG. 5 is a cross-sectional view of the present invention comprising a silo type storage tank with a channel spray and overflow tube cleaning fixture.
Figure 6:
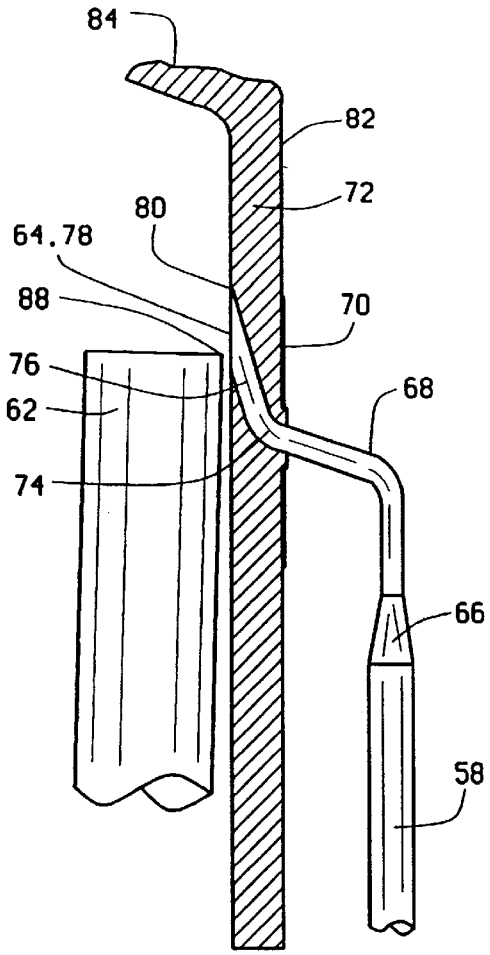
FIG. 6 is an enlarged partial cross-sectional side view of the channel and overflow tube cleaning fixture.
Figure 7:
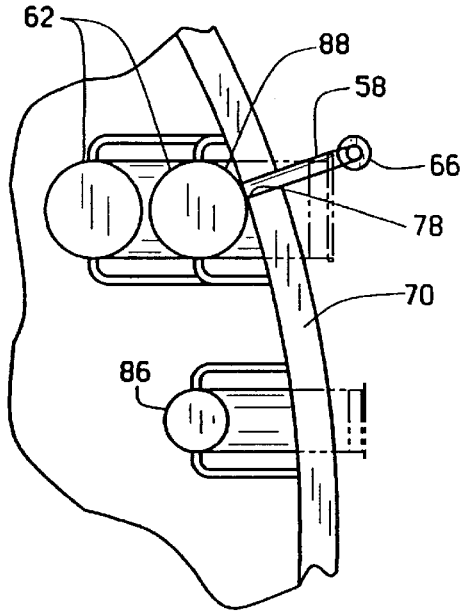
FIG. 7 is an enlarged partial cross-sectional top view of the channel and overflow tube cleaning fixture.
Figure 8:
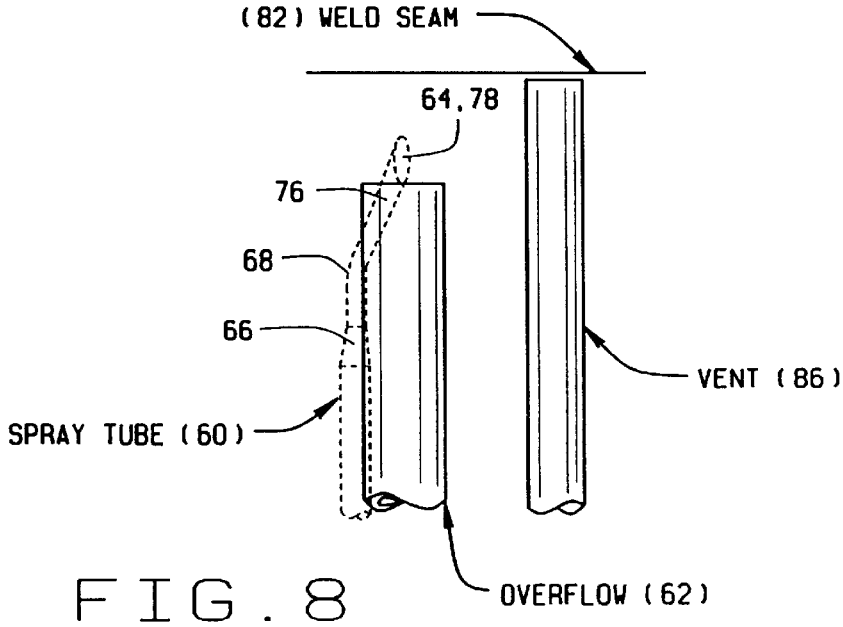
FIG. 8 is an enlarged view taken from the inside of the tank and detailing the channel opening.

The present invention is shown in FIG. 5 and includes a silo type storage tank 56 having a supply line 58 running vertically along the height of the tank 56 and entering the tank 56 near the top 60 of the tank, as well as an overflow tube 62 running vertically inside the tank 56 and up to a point just adjacent the spray opening 64 (see FIGS. 6 and 7). The clean-in-place system may also be provided separately or as a retrofit kit for adapting existing silo tanks. As shown in greater detail in FIGS. 6–8, the supply line 58 has a reducer 66 to neck down preferably to a nominal tube size of 0.87 inches ID before angling at elbow 68 for entry through a silicone escutcheon 70 into the tank sidewall 72. Inside the tank sidewall 72, the supply line 58 angles again at elbow 74 and forms a channel 76 which exits the interior tank sidewall 72 through an opening 78 which is preferably flush with the interior tank sidewall 72. As noted in FIG. 6, the centerline of channel 76 preferably forms an "angle of attack" with the interior surface of tank sidewall 72 of preferably approximately 17.35 degrees. Also as noted in FIG. 6, the upper edge 80 of opening 78 is preferably approximately four and one half inches from a weld seam 82 joining the tank sidewall 72 with the tank top 84. The opening 78 is preferably shaped as an ellipse, as the channel 76 is substantially circular in cross-section. However, the inventor has determined that the shape of opening 78 is not particularly important to achieving a desirable spray coverage over the tank interior surfaces. With the preferred embodiment described above, a flow rate of 120 gpm at 70 psi divided into 90 gpm at 40 psi of cleaning fluid through the opening 78 and the balance of the flow divided substantially equally between the overflow tube 62 and a vent tube 86 also located within the tank 56 so that each has approximately 15 gpm at 0 psi at their tops has been found to adequately clean tanks of varying sizes ranging from a little over eight feet to a little over twelve feet in diameter. It is known in the prior art to pump water upwardly through a vent tube or the like such that the water does not spray out the top of the tube but merely cascades over the lip surface and flows evenly down the sidewalls, as is experienced at 0 psi at the top. However, it is not known in the prior art that this technique may be used to wash the tank sidewall surface beneath a spray opening as with the present invention. These parameters comprise the inventor's preferred embodiment. However, other combinations are believed to also work adequately as well and may be readily determined by one of ordinary skill in the art without undue experimentation.

As shown in greater detail in FIG. 7, the overflow tube 62 has a "crook" in it as it wends its way up from the bottom of the tank from where it enters, and is arranged to have its upper lip/opening 88 substantially aligned with and located approximately one fourth inch away from the lower lip of opening 78. This ensures that cleaning fluid flowing up and over the lip 88 will adequately wash the tank sidewall immediately beneath opening 78. It is also noted that overflow tube 62 is preferably substantially aligned along the same radial that opening 78 is located on. This again ensures that a uniform flow of cleaning fluid washes over and down the tank sidewall immediately beneath and on both sides of opening 78.

It should be noted that there are variations which may be made to the present invention without departing from the spirit and scope thereof. For example, the channel may be formed by the supply line being welded at its point of entry into the tank sidewall and the channel separately formed within the tank sidewall, or the supply line may be continuous and fitted into the tank sidewall such that the channel is part of the supply line. Depending on the thickness of the tank sidewall, and other fabrication issues, one arrangement may be preferred over the other. Although the preferred embodiment depicts two elbows in the supply line/channel, this arrangement is shown as it renders fabrication easier by enlarging the entry angle for the supply line into the tank sidewall for easier welding. However, this is an accommodation for ease of fabrication and does not affect the operation of the cleaning system. These elbows could be eliminated and the cleaning system would work just as well. Various materials could be substituted for those disclosed herein, subject to good manufacturing and fabrication practices as would be well known to those of ordinary skill in the art. The combination opening/overflow tube arrangement could be positioned at varying positions about the circumference of the tank, and are preferably depicted to be located immediately above the alcove area of the tank for ease in fabrication only. It is noted that the flow of cleaning fluid is unobstructed from the opening to the tank top and sidewall, although the overflow tube is oriented nearby and may provide the slightest of obstruction for what may be only a very small portion of the spray emanating from the opening. This is not meant to detract from the intended meaning when the word unobstructed is used. It is further noted that the opening forms a sharp transition at the tank sidewall, although other transitions may work equally as well and would be considered as "flush" as there is no substantial protrusion at the opening which extends beyond the profile of the sidewall. Still other changes and modifications would be apparent to one of ordinary skill in the art, and those changes and modifications are intended to be included in the scope of the invention which should be considered as limited only by the appended claims and their legal equivalents.

What is claimed is:

1. A silo type storage tank having a clean-in-place system for cleaning inside surfaces of said tank including its top and sidewalls, said system comprising an upwardly directed channel through the sidewall of said tank for spraying a cleaning fluid onto the inside top surface of the tank and an overflow line oriented inside the tank to direct a cleaning fluid against the sidewall of the tank beneath the channel opening to thereby clean the sidewall below the channel opening as well as the exterior of the overflow line.

2. The tank of claim 1 further comprising a supply line terminating at the tank sidewall, and wherein the channel is formed in said tank sidewall to extend between said supply line and the channel opening.

3. The tank of claim 1 further comprising a supply line extending through the sidewall to form the channel, the channel and supply line thereby comprising a continuous tube.

4. The tank of claim 1 wherein said channel opening is approximately four and one half inches below a weld seam joining the top to the tank sidewall, and the channel is in the shape of a tube oriented with its centerline at approximately 17.35 degrees from the tank sidewall.

5. The tank of claim 1 wherein the overflow line is oriented with respect to the channel opening to be substantially along a single radius extending from a center of said tank.

6. The tank of claim 1 wherein said channel opening is substantially flush with the tank sidewall and with an upper edge thereof being located approximately four and one half inches below a weld seam joining the top to the tank sidewall, and the channel is substantially circular in cross-section with a diameter of approximately 0.87 inches.

7. The tank of claim 1 wherein the channel is oriented with its centerline at approximately 17.35 degrees from the tank sidewall.

8. A clean-in-place system for cleaning inside surfaces of a silo type storage tank including its top and sidewalls, said system comprising a supply line for forming at least part of an upwardly directed channel in the sidewall of said tank for spraying a cleaning fluid onto the inside top surface of the tank, and an overflow line for being oriented inside the tank to direct a cleaning fluid against the sidewall of the tank beneath the channel opening to thereby clean the sidewall below the channel opening as well as the exterior of the overflow line.

9. The clean-in-place system of claim 8 wherein said supply line is adapted to extend through the sidewall to form the channel, said supply line and channel thereby comprising a continuous tube.

10. The clean-in-place system of claim 8 wherein said channel opening is formed with an upper edge located approximately four and one half inches below a weld seam joining the tank top to the tank sidewall, said supply line has a substantially circular cross-section with a diameter of approximately 0.87 inches, and the channel is adapted to be oriented with its centerline at approximately 17.35 degrees from the tank sidewall.

11. A silo type storage tank having a clean-in-place system for cleaning inside surfaces of said tank including its top and sidewalls, said system comprising a substantially flush opening formed in the tank sidewall for spraying a cleaning fluid onto at least the inside top surface of the tank and an overflow line oriented inside the tank to direct a cleaning fluid against the sidewall of the tank beneath the opening to thereby clean the sidewall below the opening as well as the exterior of the overflow line.

12. The storage tank of claim 11 wherein cleaning fluid sprayed through said opening is substantially unobstructed in its path to the tank top and sidewall.

13. The storage tank of claim 12 further comprising a duct through the tank sidewall communicating with said opening, the portion of said duct adjacent said opening being aligned with its centerline angled at approximately 17.35 degrees to the tank sidewall.

14. The storage tank of claim 13 wherein said opening is positioned with an upper edge thereof approximately four and one half inches below a joint between the tank sidewall and the tank top.

15. The storage tank of claim 14 wherein said overflow line is substantially vertically oriented and with an upper edge positioned at approximately a lower edge of said opening.

16. The storage tank of claim 15 wherein said duct has a substantially circular cross-sectional shape so that said opening is substantially elliptically shaped at the tank sidewall surface.

17. The storage tank of claim 16 wherein said overflow line is a tube entering the tank at a lower portion thereof, said tube being substantially circular in cross-section.

18. The storage tank of claim 17 further comprising a supply line communicating with said duct and wherein said duct is angled as it traverses said tank sidewall to thereby accommodate an entry angle substantially greater than 17.35 degrees for said supply line as it joins said duct at the tank outer sidewall.

19. The storage tank of claim 18 wherein said clean-in-place system is fixed in place in the storage tank, and not required to be moved for either cleaning or operation of the storage tank.

20. A silo type storage tank having a clean-in-place system for cleaning inside surfaces of said tank including its top and sidewalls, said system comprising an opening formed in the tank sidewall and configured for the unobstructed spraying of a cleaning fluid onto at least the inside top surface of the tank and an overflow line oriented inside the tank to direct a cleaning fluid against the sidewall of the tank beneath the opening to thereby clean the sidewall below the opening as well as the exterior of the overflow line.

21. A method for cleaning an inside of a silo type storage tank, including the tank top and sidewalls, comprising the steps of:

providing an upwardly directed duct having an opening substantially flush with the tank sidewall and near the tank top through which a cleaning fluid may be sprayed, providing an overflow standpipe having an outlet substantially adjacent to the opening through which a cleaning fluid may be sprayed, and pumping a cleaning fluid through the duct and the standpipe to thereby spray cleaning fluid against the inside of the tank top and sidewall to thereby clean them.

* * * * *